US008951278B2

(12) United States Patent
Reil

(10) Patent No.: US 8,951,278 B2
(45) Date of Patent: Feb. 10, 2015

(54) POST CARRIER FOR BODY PIERCING INSTRUMENT

(76) Inventor: Vladimir Reil, Rancho Palos Verdes, CA (US)

( * ) Notice: Subject to any disclaimer, the term of this patent is extended or adjusted under 35 U.S.C. 154(b) by 923 days.

(21) Appl. No.: 12/730,768

(22) Filed: Mar. 24, 2010

(65) Prior Publication Data

US 2011/0238103 A1 Sep. 29, 2011

(51) Int. Cl.
*A61B 17/34* (2006.01)
*A44C 7/00* (2006.01)

(52) U.S. Cl.
CPC ..... *A44C 7/001* (2013.01)
USPC ..... 606/188

(58) Field of Classification Search
CPC ..... A44C 7/00; A44C 7/001; A44C 7/002
USPC ..... 606/181, 182, 185, 188
See application file for complete search history.

(56) References Cited

U.S. PATENT DOCUMENTS

| | | | | |
|---|---|---|---|---|
| 4,527,563 | A * | 7/1985 | Reil | 606/188 |
| 4,921,494 | A | 5/1990 | Reil | |
| 5,772,679 | A * | 6/1998 | Mann | 606/188 |
| 6,036,712 | A * | 3/2000 | Blomdahl | 606/188 |
| 6,183,490 | B1 * | 2/2001 | Korbar et al. | 606/188 |
| RE37,937 | E * | 12/2002 | Mann | 606/188 |

* cited by examiner

*Primary Examiner* — Thomas McEvoy
*Assistant Examiner* — Julie A Szpira
(74) *Attorney, Agent, or Firm* — Canady & Lortz LLP; Bradley K Lortz

(57) ABSTRACT

Apparatuses and systems for ornamental piercing of body parts are disclosed. Various embodiments of the invention employ a post carrier which includes a cylindrical recess at a first end for holding an ornament of a post for piercing. A wall of the cylindrical recess of the post carrier further includes at least one wall recess for engaging a point on the ornament of the post. The at least one wall recess may include a spring finger extending from a side of the at least one wall recess applying a cantilever force to the point on the ornament engaged in the at least one wall recess for holding the post. The post carrier provides more consistent holding force of the post across typical manufacturing tolerance ranges to provide both secure engagement of the post for handling and piercing and later disengagement without discomfort to the user.

21 Claims, 5 Drawing Sheets

POST CARRIER FOR BODY PIERCING INSTRUMENT

BACKGROUND OF THE INVENTION

1. Field of the Invention

The present invention relates to apparatuses and methods for ornamental piercing of body parts. Particularly, the present invention relates to apparatuses and methods for holding a stud post for body piercing performed with a hand-operated body piercing instrument.

2. Description of the Related Art

In recent years, body piercing has become an increasingly common practice in the U.S. and throughout the world. Although the piercing of body parts is ancient, the practice is rapidly becoming a routine procedure, often performed by laypersons without medical experience or training. It is also important to understand that mainstream body piercing has evolved to include piercing of body parts other than just the ear. For example, piercing of flesh near the naval or belly button, eyebrow, lip, etc., are presently much more common than previously. Presently, a number of manually operated devices are available that allow for the safe, hygienic, user-friendly piercing of body parts. Examples of such systems are disclosed in U.S. Pat. No. 5,496,343 by Reil, issued Mar. 5, 1996, U.S. Pat. No. 5,792,170 by Reil, issued Aug. 11, 1998, U.S. Pat. No. 5,868,774 by Reil, issued Feb. 9, 1999, U.S. Pat. No. 6,599,306 by Reil, issued Jul. 29, 2003, and U.S. Pat. No. 6,796,990 by Reil, issued Sep. 28, 2004, all of which are incorporated by reference herein.

In addition to piercing entirely by hand with a needle, there are a variety of body piercing systems available today. These various body piercing systems essentially comprise a stud (also called an earring or a piercing earring) which includes an affixed ornamental piece with a post (also called a stud, pin or a piercing pin) and a nut (sometimes called a clasp) that are mounted in a cartridge. During the piercing process, the body part (e.g., an ear lobe) is placed between the post and the nut and the cartridge is squeezed, either by hand or by operating it in a special body piercing system (or "gun," instrument or assembly), which causes the post to pierce the body part and engage the nut. One particular body piercing assembly employs separate carriers for both of the post and the nut which are separately engaged into different locations of the body piercing assembly before piercing.

For example, U.S. Pat. No. 4,527,563, issued Jul. 9, 1985, to Reil, discloses an ear stud emplacement system that embodies a guntype stud setting member wherein sterility in high hygiene conditions are maintained in the piercing of ears and the setting of studs or posts thereinto in secure relationship with the back clasp or nut of the stud or post. The improved system utilizes a stud gun having the components that come in contact with the earlobe and the like, that are disposable. The system allows for emplacement of sterile components and the placement of stud and back in the ear under sterile conditions not requiring touching of, for example, the stud and clasp with human hands or the touching of the replaceable components of the stud gun with human hands thereby decreasing the risk involved, of one getting their ears pierced.

In addition, U.S. Pat. No. 4,921,494, issued May 1, 1990, to Reil, discloses a disposable stud carrier and one-piece earring carrier for holding a clasp for attachment to an earring stud and providing a guide to direct the forward movement of the stud into the clasp. The earring carrier is used in conjunction with a stud gun having a protuberance upon its end of which the earring carrier may be positioned upon and so held.

One difficulty associated with piercing systems employing separate carriers for the nut and post is that each carrier must be separately installed into the piercing system before use. The separate carriers may be small and difficult to handle. The post and the nut must each be securely held in their respective carriers in proper alignment for the piercing. In addition, each carrier must be securely engaged to the piercing system when installed. In the case of the post carrier, occasionally the post may become dislodged from the carrier and fall to the floor. On the other hand, the nut carrier may accidentally become disengaged from the piercing instrument. In any such event, any components that are dropped must be discarded because they are no long hygienic.

Like any product, it is also desirable to produce piercing instruments at reduced costs. Every additional manufacturing step adds additional cost to the end product. For example, current a conventional body piercing instrument that employs separate carriers for the nut and post has a metal flange that is welded to a cylindrical portion that is used to engage the nut carrier. Although a welded flange is cheaper than machining the entire part from larger stock, eliminating the need for a welded flange would present a cheaper alternative. However, such a solution would need to first meet the requirements of providing secure engagement and alignment of the nut carrier to the body piercing instrument.

Inevitably, there are differences among the different manufactured units of any product. Thus, it is desirable that the design of a product accommodates the full range of manufacturing tolerances between mating parts that will result across the produced units. Meeting this objective results in greater customer satisfaction and fewer returned defective components. Prior art post carriers for body piercing instruments which are designed to hold the ornament of a post through a press fit (or interference fit) between the largest outer dimension of the ornament and the inner diameter of a cylindrical wall may yield inconsistent holding force applied to the post. The resulting holding force from a such a press fit engagement can vary widely with only very small changes in the difference between the ornament size and the cylindrical recess diameter. While improving manufacturing tolerances between the parts may address the issue, this would also involve additional costs. (Molded plastic components are inexpensive but difficult to maintain to tight tolerances, for example. Machined parts would be more precise but much more costly.) Thus, ordinary manufacturing tolerances between the ornament and a molded plastic post carrier can easily yield either too flimsy or too rigid an engagement between the ornament and the post carrier. In the former case, the post might fall out of the carrier during handling before piercing and in the latter case, the post may be difficult to remove from the carrier after piercing resulting in discomfort to the recipient.

In view of the foregoing, there is a need for apparatuses and systems that provide for simple, accurate, repeatable and safe body piercing. There is a need for methods and apparatuses for piercing systems to allow efficient and hygienic loading of separate carriers for the nut and post. There is particularly a need for such methods and apparatuses that provide separate carriers for the nut and post that are more easily manipulated and that operate with a reduced likelihood that sterile components may be dropped during loading. Further, there is also a need for such methods and apparatuses to reduce manufacturing costs, e.g. by reducing the cost of disposable parts. There is a need for designs that yield consistent performance without requiring precision manufacturing tolerances. There is also a need for such methods and apparatuses to employ standard components which can be employed with different piercing techniques. As discussed hereafter, the present invention meets these and other needs.

SUMMARY OF THE INVENTION

Apparatuses and systems for ornamental piercing of body parts are disclosed. Various embodiments of the invention employ a post carrier which includes a cylindrical recess at a first end for holding an ornament of a post for piercing. A wall of the cylindrical recess of the post carrier further includes at least one wall recess for engaging a point on the ornament of the post. The at least one wall recess may include a spring finger extending from a side of the at least one wall recess applying a cantilever force to the point on the ornament engaged in the at least one wall recess for holding the post. The post carrier provides more consistent holding force of the post across typical manufacturing tolerance ranges to provide both secure engagement of the post for handling and piercing and later disengagement without discomfort to the user.

A typical embodiment of the invention comprises a post carrier for a body piercing instrument including a cylindrical recess at a first end for holding a post, where a wall of the cylindrical recess includes at least one wall recess for engaging a point on the ornament of the post, and a cylindrical portion disposed at a second end for insertion into a post carrier coupling recess of the body piercing instrument. The post comprises an ornament held within the cylindrical recess. The post carrier may be a unitary piece and may be manufactured as a molded plastic piece. Typically, the at least one wall recess may comprise opposing wall recesses.

In further embodiments, each of the at least one wall recess includes a spring finger extending from a side of each of the at least one wall recess. The spring finger in each of the at least one wall recess may be flush with the wall of the cylindrical recess for holding the post. In addition, the spring finger in each of the at least one wall recess may apply a cantilever force to the point on the ornament engaged in each of the at least one wall recess for holding the post.

In some embodiments, the cylindrical portion disposed at the second end may comprise a raised lip on an outside diameter of the cylindrical portion. In addition, the post carrier may further comprise a planar portion disposed between the cylindrical recess and the cylindrical portion. The planar portion may operate as a stop for indexing against an end of the post carrier coupling recess of the body piercing instrument.

Another embodiment of the invention may comprise a body piercing instrument including a handle portion supporting both a post carrier coupling for engaging a post carrier supporting a post comprising an ornament and a nut carrier coupling for engaging a nut carrier supporting a nut, both the post carrier coupling and the nut carrier coupling in substantially parallel sliding engagement such that the post of the engaged post carrier is aligned to pierce a body part and engage the nut of the engaged nut carrier. The post carrier coupling comprises a cylindrical recess at a first end for holding the ornament of the post where a wall of the cylindrical recess includes at least one wall recess for engaging a point on the ornament of the post, and a cylindrical portion disposed at a second end for insertion into a post carrier coupling recess of the body piercing instrument. The body piercing instrument may be further modified consistent with other apparatus embodiments described herein.

Yet another embodiment of the invention encompasses a post carrier for a body piercing instrument comprising a cylindrical recess means for holding a post at a first end, where a wall of the cylindrical recess means includes at least one wall recess means for engaging a point on the ornament of the post, and a cylindrical portion means for insertion into a post carrier coupling recess of the body piercing instrument and disposed at a second end. The post comprises an ornament held within the cylindrical recess means. The post carrier may be a unitary piece. The each of the at least one wall recess means may include a spring finger means for applying a cantilever force to the point on the ornament engaged in each of the at least one wall recess means for holding the post. The post carrier may be further modified consistent with other apparatus embodiments described herein.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description including the preferred embodiment, reference is made to the accompanying drawings which form a part hereof, and in which is shown by way of illustration specific embodiments in which the invention may be practiced. It is to be understood that other embodiments may be utilized and structural changes may be made without departing from the scope of the present invention.

1.0 Body Piercing Instrument

As mentioned above, various embodiments of the invention are designed to be used with and encompass a body piercing instrument for ornamental piercing of body parts. Embodiments of the invention are applicable to body piercing instruments employing separate carriers for the nut and post elements of the body piercing. Each carrier is loaded onto separate couplings of the body piercing instrument, one for the nut carrier and one for the post carrier, such that the nut and post are aligned for the piercing. The body piercing instrument is then operated to pierce a flap skin with the post and have it engage the nut as it emerges through the skin. Both the post and nut carriers incorporate novel structural features that enhance there use. For example, the nut carrier has an interface structure to the body piercing instrument that is more easily manufacturable and also allows that the body piercing instrument is more easily manufacturable. In addition, the post carrier includes features that afford more improved retention of the post allowing for greater manufacturing tolerances of the component.

Embodiments of the invention may be employed with almost any type of body piercing instrument that uses separate cartridges for the nut and the post. The physical configuration may be a "gun," although any other known configuration may also be employed. The piercing action of the body piercing instrument is typically derived from a spring-loaded post carrier coupling that is triggered to release when the nut carrier coupling is drawn back by hand pressure applied to a trigger member attached to the nut carrier coupling. The spring-loaded post carrier coupling is released suddenly only after the nut carrier coupling reaches the end of its travel.

Figures 1A, 1B:
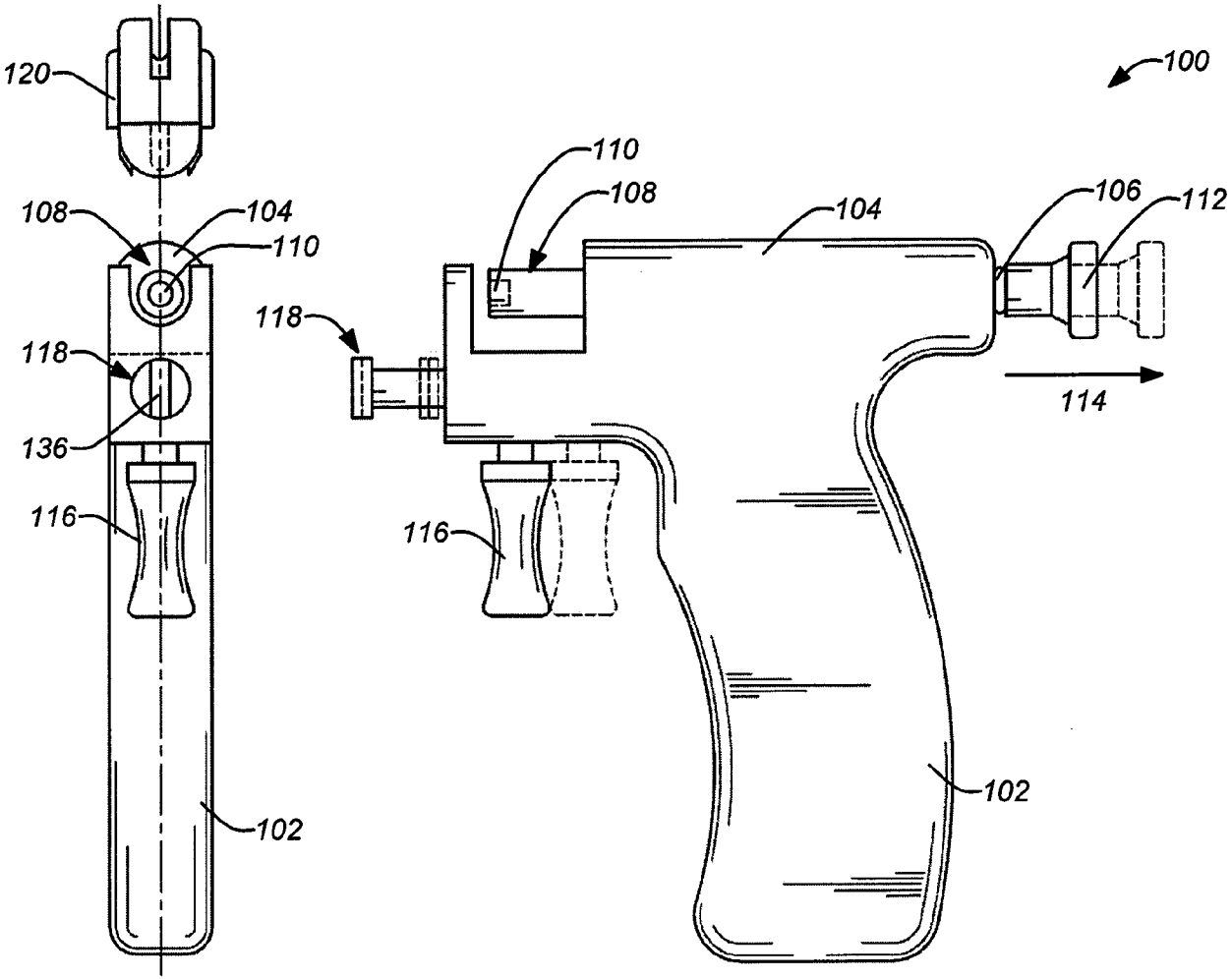
FIG. 1A illustrates a front view of an exemplary body piercing instrument embodiment of the invention.
FIG. 1B illustrates a side view of an exemplary body piercing instrument embodiment of the invention.

FIGS. 1A & 1B show front and side views, respectively, of an exemplary body piercing instrument embodiment of the invention. The exemplary body piercing instrument 100 has a "gun" configuration and includes a handle portion 102 and a barrel portion 104. The barrel portion 104 carries a plunger member 106 in sliding engagement (passing through the barrel portion 104) and having a post carrier coupling 108 at one end which includes a recess 110. The recess 110 typically comprises a hollow cylindrical cavity bored into the end of the plunger member 106. The opposite end of the plunger member 106 has a knob 112 affixed thereto for manipulation by the operator. In preparation for use, the operator pulls the knob 112 back away from the barrel portion 104 from a first, uncocked position to a second, cocked position as indicated by the arrow 114. As the plunger member 106 is pulled back it acts against a spring (not shown) until it is latched in position and is operatively connected to a trigger member 116. When the spring is triggered to release, the plunger member 106 is driven by the spring from the cocked to the uncocked position (right to left as shown in FIG. 1). It should be noted that details of the latching and triggering may be implemented through any known mechanism as will be understood by those skilled in the art.

The trigger member 116 is attached to a nut carrier coupling 118 which is also carried in sliding engagement within the barrel portion 104 substantially parallel to the sliding engagement of the plunger member 106. The nut carrier coupling 118 (and attached trigger member 116) act against another lighter spring (not shown) which operates to hold these elements forward (leftward as shown in FIG. 1). The spring of the plunger member 106 is released only when the trigger member 116 (and the attached nut carrier coupling 118) is pulled back against the resistance of it's own spring by the hand of the operator and fully reaches the end of travel (at the right dotted line image). Thus, those skilled in the art will appreciate that two separate actions occur in sequence, first drawing the trigger member 116 all the way back (from left to right in FIG. 1) until it then triggers release of the spring-loaded plunger member 106 which then snaps quickly in the opposite direction to pierce the body part as will be described hereafter.

Figure 2:
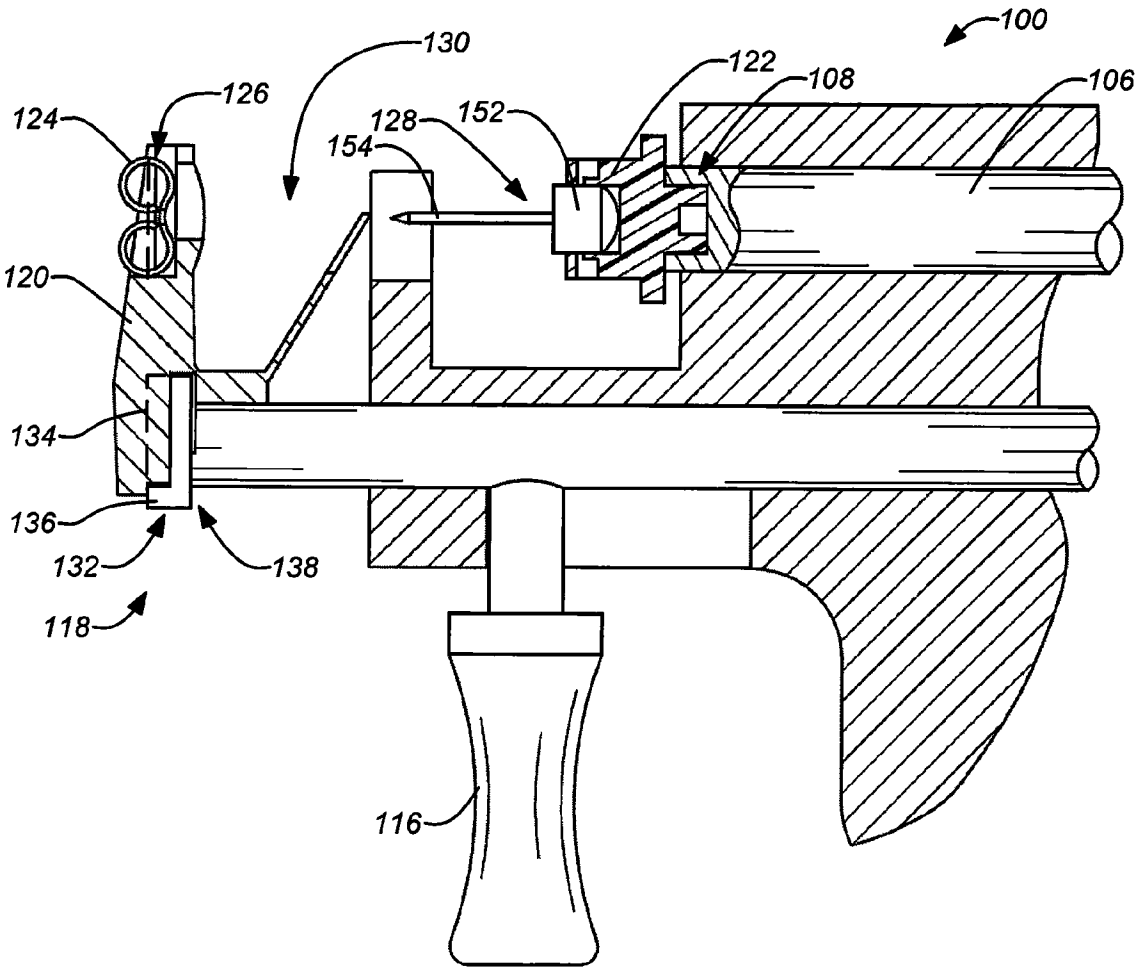
FIG. 2 illustrates a cutaway of the detailed mechanism of a body piercing instrument embodiment of the invention.

FIG. 2 illustrates a cutaway of the detailed mechanism of the body piercing instrument 100 embodiment of the invention. The body piercing instrument 100 is shown with both the nut carrier 120 and the post carrier 122 respectively engaged into the nut carrier coupling 118 and the post carrier coupling 108 of the body piercing instrument 100. The nut carrier 120 holds a nut 124 (or clasp) in an upper nut holder slot 126 as shown. When engaged in the nut carrier coupling 118, the nut carrier 120 holds the nut in alignment to receive the post 128 (held in the engage post carrier 122) as it emerges through a pierced boy part (not shown) which is positioned by the operator in the piercing region 130. Details of the novel nut carrier 120 are described in the following section.

A significant feature of the present invention requires that the nut carrier coupling 118 of the body piercing instrument 100 includes a particular cylindrical end 132. The end plane 134 of the cylindrical end 132 (cut substantially perpendicular to the axis of the cylindrical end) includes a mating vertical feature 136 cut into it for engaging the vertical feature of the nut carrier 120 (detailed hereafter). Typically, the nut carrier coupling 118 of the body piercing instrument 100 is a turned metal part having a step 138 or groove cut into it set back from the end plane 134 of the cylindrical end 132 and the mating vertical feature 136 cut into the end plane 134 of the cylindrical end 132 comprises a slot cut across the end plane 134 diameter. Although other equivalent mating vertical features may be employed as will be understood by those skilled in the art, a single vertical slot cut across the diameter of the end plane of the cylindrical end 132 provides an optimal solution for manufacturing ease. Cutting the vertical feature 136 across the diameter (e.g. a single slot across the diameter) along with the step 138 provides a significant manufacturing improvement over the prior art which employs an upwardly projecting tab affixed to the end of the nut carrier coupling. The upwardly projecting tab of the prior art is typically produced by welding it to the cylindrical end of the nut carrier coupling, a separate and more expensive process. Cutting the part including the upwardly projecting tab from larger raw stock would be even more expensive. Embodiments of the present invention employ a nut carrier coupling 118 formed simply from easily produced combination of features cut into the diameter, e.g. a single slot cut across the diameter of the end plane 134 of the cylindrical end 132 and a step 138 or groove cut into the cylindrical end 132 set back from the end plane 134.

Another significant feature of the present invention is the use of a post carrier 122 that includes features to provide secure and positive retention of the post 128. The features include at least one wall recess within the wall of the cylindrical recess that holds the post 128. Preferably, the post carrier will include opposing wall recesses in one or more pairs aligned across the cylindrical recess that holds the post 128. In addition, each of the wall recesses may preferably include a spring finger element. Ideally, these spring finger elements may be biased to bend slightly into the cylindrical recess of the post holder where the ornament of the post is held. These fingers may provide at least two primary benefits. First, they hold the post in the post holder tightly enough to prevent the stud from falling out even if the post holder is with the cylindrical recess down, but not too tight to prevent the post from being easy withdrawn from the post holder by any force slightly greater than gravity, e.g. as when piercing is performed and the post engages the nut. Second, the spring finger elements can provide a more aligned post (to be received by the nut) and more secure retention in the post holder for the posts having shaped ornaments or heads, such as the star shape, heart shaped, triangle shaped, etc. The post carrier provides more consistent holding force of the post across typical manufacturing tolerance ranges to provide both secure engagement of the post for handling and piercing and later disengagement without discomfort to the user.

All components of the body piercing instrument 100 may be manufactured from any known materials used in the art. However, the handle portion 102 and barrel portion 104 may be typically formed as a unitary molded plastic piece, i.e. a single part. Most other components, including the plunger member 106, trigger member 116, and a nut carrier coupling 118, may be machined metal components.

For some examples of applicable body piercing instruments, see e.g. U.S. Pat. No. 4,527,563 by Reil, which is incorporated by reference herein. Such body piercing instruments can be adapted to operate with embodiments of the invention as will be understood by those skilled in the art. Although a typical embodiment of the invention employ some type of spring-loaded triggered post carrier as described above, it should also be noted that embodiments of the invention may also employ other types of piercing mechanisms. For example, U.S. Patent Application Publication No. 2005-0273128, published Jun. 8, 2004, by Reil, which is incorporated by reference herein, describes a two-way action piercing assembly that may alternately be employed with embodiments of the present invention, provided the device is adapted to operate with separate carriers for both the nut and post as will be understood by those skilled in the art.

2.0 Nut Carrier

Figure 3:
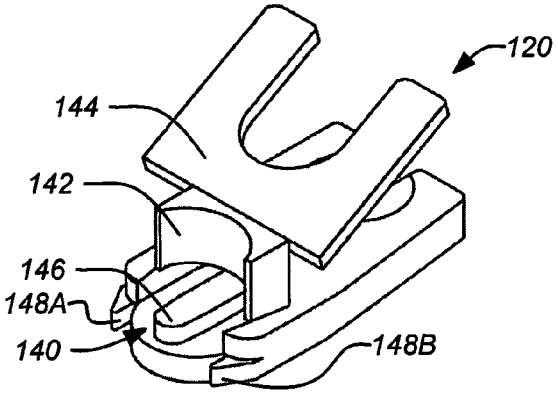
FIG. 3 shows an isometric view of the novel nut carrier embodiment of the invention.
Figure 4:
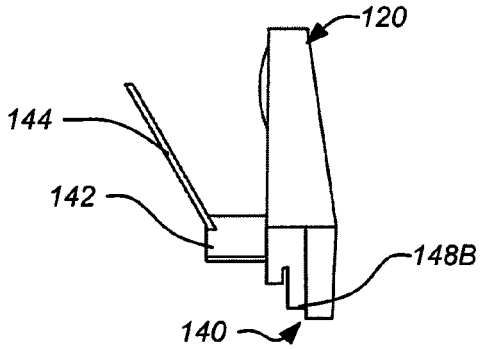
FIG. 4 shows a side view of the novel nut carrier embodiment of the invention.
Figure 5:
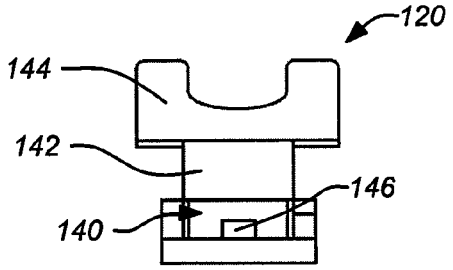
FIG. 5 shows a bottom view of the novel nut carrier embodiment of the invention.
Figure 6:
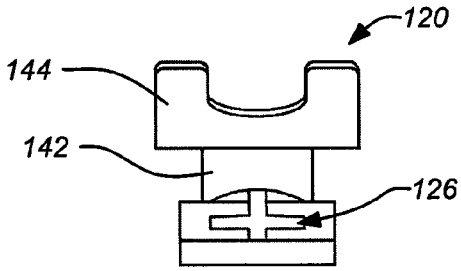
FIG. 6 shows a top view of the novel nut carrier embodiment of the invention.
Figure 7:
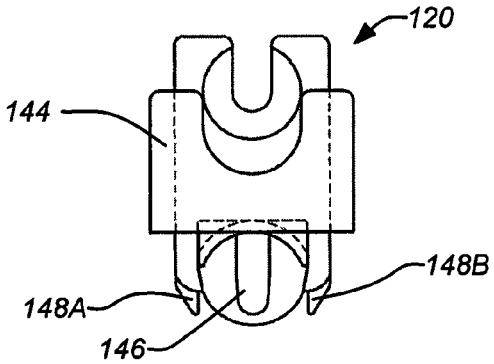
FIG. 7 shows a front view of the novel nut carrier embodiment of the invention.
Figure 8:
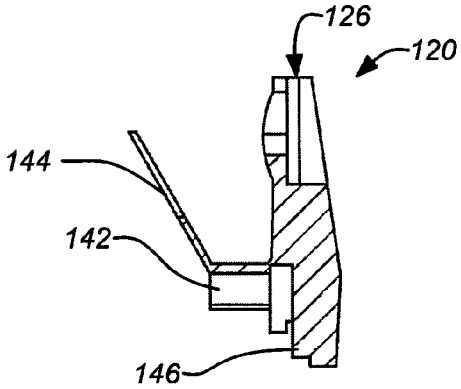
FIG. 8 shows a side cutaway view of the novel nut carrier embodiment of the invention.

FIGS. 3-8 illustrate details of the novel nut carrier 120 embodiment of the invention. As previously mentioned, the nut carrier 120 is implemented as a component in a body piercing system that employs separate carriers for the nut and the post. The novel nut carrier eliminates a welded two part flange previously employed in the body piercing instrument, saving manufacturing cost and time. FIG. 3 shows an isometric view of the novel nut carrier 120 embodiment of the invention. FIG. 4 shows a side view of the novel nut carrier 120 embodiment of the invention. FIG. 5 shows a bottom view of the novel nut carrier 120 embodiment of the invention. FIG. 6 shows a top view of the novel nut carrier 120 embodiment of the invention. FIG. 7 shows a front view of the novel nut carrier 120 embodiment of the invention. FIG. 8 shows a side cutaway view of the novel nut carrier 120 embodiment of the invention.

Typically, the nut carrier 120 is a unitary piece that may be manufactured as a molded plastic part. The nut carrier comprises an upper nut holder slot 126 and a lower coupling recess 140. The upper nut holder slot 126 holds a nut 124 (or clasp). As previously described, the nut 124 receives a post 128 after it emerges from piercing a body part using the body piercing instrument 100. The lower coupling recess 140 engages a cylindrical end 132 of a nut carrier coupling 118 of the body piercing instrument 100. The lower coupling recess 140 includes a vertical feature 146 therein that engages a mating vertical feature 136 cut into the end plane 134 of the cylindrical end 132 of the nut carrier coupling 118 of the body piercing instrument 100. When the vertical feature 146 in the lower coupling recess 140 of the nut carrier 120 and the mating vertical feature 136 of the nut carrier coupling 118 of the body piercing instrument 100 are engaged they prevent rotation between the nut carrier 120 and the nut carrier coupling 118, allowing the nut 124 to be fixed in proper alignment with post 128 for piercing. The vertical feature 146 within the lower coupling recess 140 of the nut carrier may be a beam vertically disposed in the center of the recess 140. However any other suitable vertical features 146 may also be employed as will be understood by those skilled in the art. For example, the vertical feature 146 may be the inverse of a beam, i.e. a vertical slot, or multiple vertical beams or slots, or even one or more stepped beams or slots, provided the vertical feature 146 affords a vertical sliding engagement with the mating vertical feature 136 of the nut carrier coupling 118. Thus, the vertical feature 146 of the nut carrier may be a slot and the mating vertical feature 136 of the nut carrier coupling may be a beam or visa versa.

The nut carrier 120 may also employ a U-shaped shield 144 that extend upward from the lower coupling recess 140 of the nut carrier 120. The shield 144 includes a U-shaped slot for providing passage of the post 128 after piercing the body part and engaging the nut 124 so that the engaged post 128 and nut 124 may be separated from the nut carrier 120. At the same time, the U-shaped shield 144 provides a barrier between the body part and the body piercing instrument 100 as known in the art. The shield 144 may extend from the opposite end of a saddle portion 142 disposed adjacent to the lower coupling recess 140. The saddle portion 142 rides on the step 138 or groove of the cylindrical end 132 when the nut carrier 120 is engaged to the nut carrier coupling 118.

The lower coupling recess 140 may further comprise opposing spring fingers 148A, 148B for engaging over the diameter of the cylindrical end 132 of the nut carrier coupling 118 of the body piercing instrument 100 to secure the nut carrier 120. The vertical feature 146 prevents rotation of the nut carrier 120 relative to the body piercing instrument 100 and the opposing spring fingers 148A, 148B provide a secure engagement over the diameter of the cylindrical end 132 of the nut carrier coupling 118 of the body piercing instrument 100.

The exemplary nut carrier 120 also includes an upper nut holder slot 126 for engaging and securely holding a nut 124. See FIGS. 2, 6 and 8. The face and back of the upper nut holder slot 126 each also include a U-shaped slot like the shield 144 so that the engaged post 128 and nut 124 may be separated from the nut carrier 120 after piercing. Typically, the nut 124 comprises a front plate portion that slides into the slot 126 and opposing looped spring elements that curve back from the front plate portion. The opposing looped spring elements are spread by the post 128 and apply pressure thereby to hold the post 128.

The nut carrier 120 may be optimally manufactured as a unitary piece, e.g. a single molded plastic component. The component may be produced from molded plastic, nylon or any other known material suitable for use in piercing or medical procedures. It should be noted that the relative sizes shown in the figures are only exemplary; those skilled in the art may develop specific designs having any reasonable dimensions applying the described principle of the applicable embodiment of the invention.

3.0 Post Carrier

Figure 9:
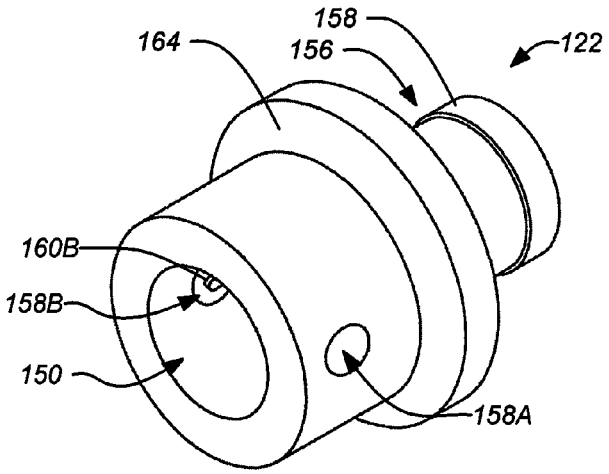
FIG. 9 shows an isometric view of a novel post carrier.
Figure 10:
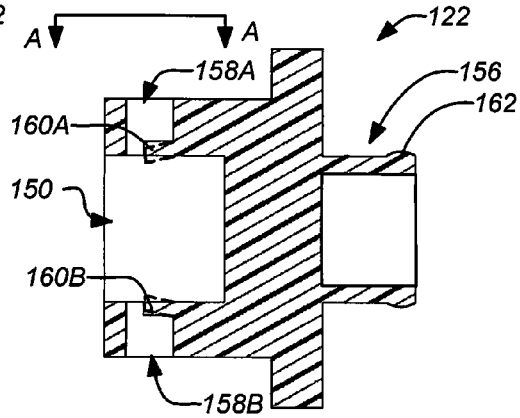
FIG. 10 shows a cutaway view of the novel post carrier through the wall recesses and spring finger elements.
Figure 11:
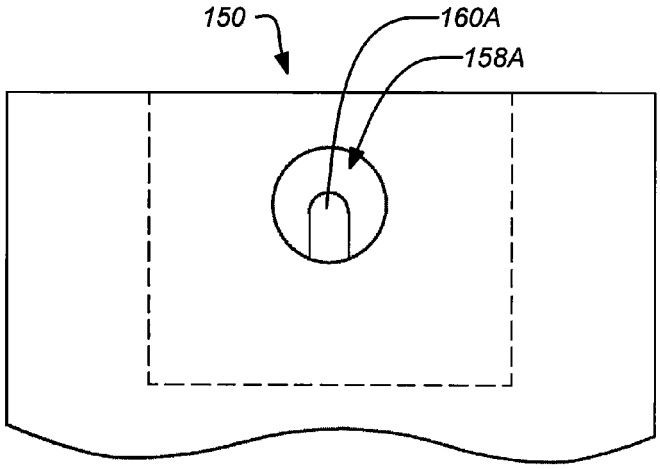
FIG. 11 shows detail view A-A identified in FIG. 10 of a spring finger of the novel post carrier.

FIGS. 9-11 illustrate a novel post carrier embodiment of the invention. The novel post carrier 122 comprises a cylindrical recess 150 at one end for holding the post 128. FIG. 9 shows an isometric view of the novel post carrier 122. Particularly, the post carrier 122 is designed to carry a post 128 comprising an ornament 152 attached to the back of the sharpened piercing pin 154. See FIG. 2. The opposite end of the post carrier 122 comprises a cylindrical portion 156 for insertion into the recess 110 of the post carrier coupling 108 in the end of the plunger member 106 of the body piercing instrument 100. See FIGS. 1A & 1B. The cylindrical portion 156 may further include a raised lip 162 at its end disposed on an outside diameter of the cylindrical portion 156 to provide a secure (but removable) press fit engagement into the recess 110 of the post carrier coupling 108 when the body piercing instrument 100 is used. In addition, the cylindrical recess 150 and the cylindrical portion 156 may be separated from each other by a planar portion disposed therebetween. The planar portion may also be cylindrical and may operate as a stop for indexing against the end of the post carrier coupling 108 of the plunger member 106. It should be noted that, while the nut carrier 120 employs a vertical feature 146 to prevent rotation and hold it in a fixed orientation, there is no requirement that the post carrier obtain an fixed rotational orientation.

A significant feature of the novel post carrier 122 is the inclusion of at least one wall recess 158A, 158B in the wall of the cylindrical recess 150. The wall recesses 158A, 158B provide more secure engagement of the post 128. Particularly, the wall recesses 158A, 158B each engage a point on the ornament 152 of the post 128. It should be noted that although the wall recesses are shown in the figures as being circular, those skilled in the art will appreciate that any shape may be use, e.g. square, rectangular or any polygonal shape. In addition, although the wall recesses 158A, 158B are shown in the figures as a pair of wall recesses, only one wall recess may be required in some embodiments, provided it is sufficient to hold the particular post 128. Alternately, more than two wall recesses 158A, 158B may also be as necessary to hold a particular post 128.

Preferably, the wall recesses for engaging points of the post may provided in pairs comprising opposing wall recesses, each for engaging a point on the ornament of the post. Typically, the ornament 152 comprises a symmetrical design having at least two points on opposite sides across a widest dimension of the ornament 152 to engage with the opposing wall recesses 158A, 158B. It should be noted that a "point" on the ornament 152 only identifies the location of the contact with the ornament 152 and need not be sharp or have any specific shape; in this context a "point" on the ornament is simply a high spot as measured from a central axis of the post 128.

FIG. 10 shows a cutaway view of the novel post carrier 122 through the wall recesses 158A, 158B and spring finger 160A, 160B elements. FIG. 11 shows a detail view A-A identified in FIG. 10 of a spring finger of the novel post carrier. To further improve the secure engagement of the ornament 152 in the post carrier 122, each of the wall recesses 158A, 158B may include a spring finger 160A, 160B extending from a side of the recesses 158A, 158B. Each spring finger 160A, 160B extends from a side of the wall recesses 158A, 158B flush with the wall of the cylindrical recess 150 and applies a cantilever force to a point of the ornament 152 engaged at the wall recess. In this position, the spring fingers 160A, 160B each apply opposing cantilever force to the two opposite points of the ornament 152 across the cylindrical recess 150 and thereby hold the post 128 very securely. However, the cantilever spring fingers 158A, 158B deliver force that is less sensitive to dimensional variation than a prior art cylindrical recess alone, i.e. a press fit engagement. Because the force is applied by cantilever spring fingers 158A, 158B to the two points of the ornament 152 engaged in the opposing recesses 158A, 158B, the post 128 may also be dislodged from the post carrier 122 without a need for excessive force by the operator. The novel post capture mechanism afforded by the opposing recesses 158A, 158B and the spring fingers 160A, 160B provides an optimum balance between secure engagement during installation and piercing and removability thereafter. Note that the cantilever spring fingers 160A, 160B may take any known configuration provided they provide some force to the ornament 152 of the post 128. However, typically the spring fingers 160A, 160B are biased to bend slightly into the main cylindrical recess 150 of the post carrier 122 as indicated by the dashed outlines shown in FIG. 10.

As previously discussed, prior art post carriers without the wall recesses 158A, 158B and the spring fingers 160A, 160B might suffer from one of two possible problems. In this case, the ornament would be held only by the interior cylindrical wall of the post carrier in a press fit engagement. The resulting holding force from a press fit engagement can vary widely with only very small changes in the difference between the ornament size and the cylindrical recess diameter. Manufacturing tolerances between the ornament and the molded plastic post carrier can easily yield either too flimsy or too rigid an engagement between the ornament and the post carrier. In the former case, the post might fall out of the carrier during handling before piercing. In the latter case, the post might be difficult to remove from the carrier after piercing resulting in discomfort to the recipient. The novel post carrier 122 provides a more consistent holding force across a wider range of manufacturing tolerances between the ornament size and the cylindrical recess diameter to and ease of removability. It should be noted that even employing the at least one recess 158A, 158B (or preferably opposing recesses) without the spring fingers 160A, 160B can yield some benefit because a press fit engagement may be avoided as the recess(es) 158A, 158B can function as a detent for the point(s) of the ornament 152. However, the addition of the spring fingers 160A, 160B provides a more stable engagement of the ornament 152 and more precise alignment of the piercing pin in body piercing instrument 100.

Figure 12:
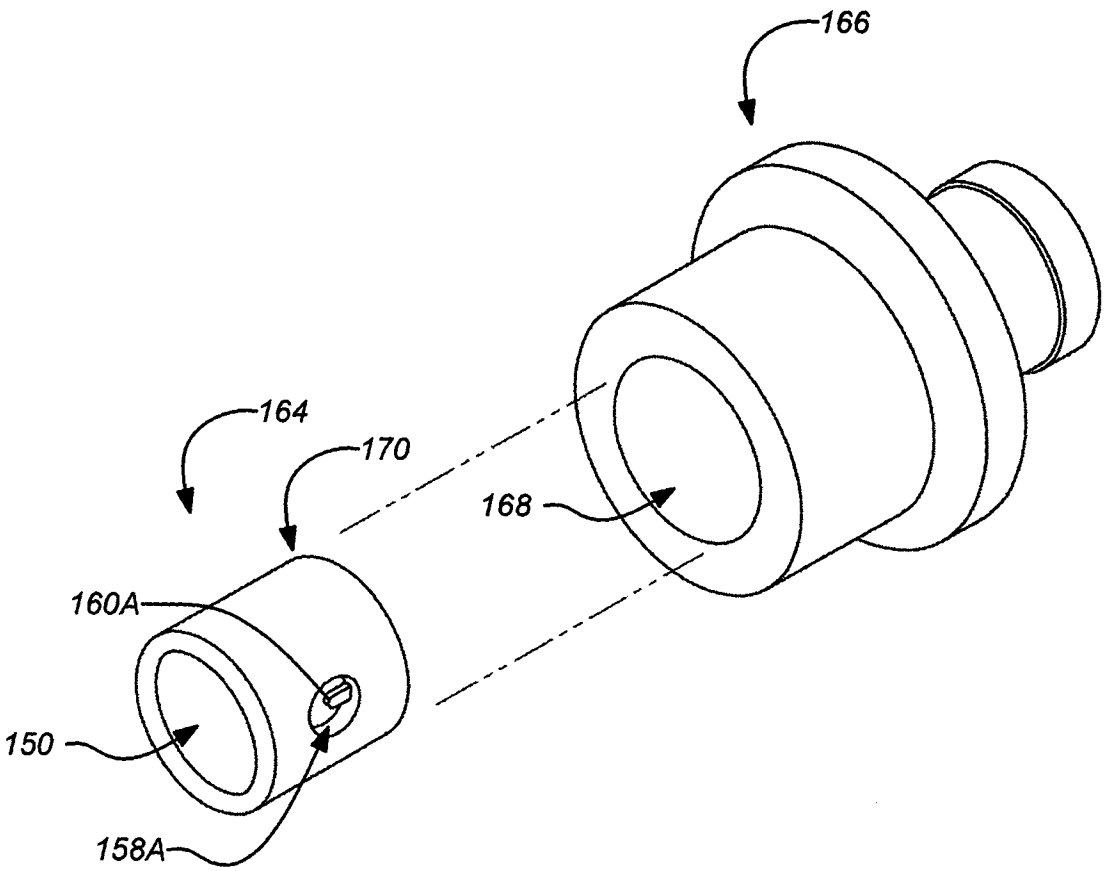
FIG. 12 shows a post carrier comprising a single cylindrical shape with at least one wall recess and spring finger that may be retrofitted into a conventional post carrier.

FIG. 12 shows a post carrier 164 comprising a single cylindrical shape with at least one wall recess 158A and a spring finger 160A, that may be retrofitted into a conventional post carrier 166. (Note that the recess 158B and spring finger 160B are not shown in the figure but may be disposed in the same opposing relative position and function in the same manner as the recess 158B and spring finger 160B of the post carrier 122 of the previous figures.) The conventional post carrier 166 is installed in the post carrier coupling 108 of the body piercing instrument 100 in operation and should be considered part of the body piercing instrument 100 for the purposes of the description and claims herein. In this case, the recess 168 of the conventional post carrier 166 should be considered as the recess 110 of the post carrier coupling 108 of the body piercing instrument 100 and the cylindrical end 170 of the post carrier 164 opposite the recess 150 should be considered as the cylindrical portion 156 of the post carrier 122 of the previous figures. The retrofit post carrier 164 is useful because it provides all the benefits of the post carrier 122 of the previous figures at a minimum cost (where local laws allow reuse of the conventional post carrier 166). Typically, the retrofit post carrier 164 may be a single molded plastic component that is employed where the conventional post carrier 166 is metal.

Like the nut carrier 120, the post carrier 122 (or retrofit post carrier 164) may also be optimally manufactured as a unitary piece, e.g. a single molded plastic component. The component may be produced from molded plastic, nylon or any other known material suitable for use in piercing or medical procedures. Any spring fingers that may be employed may likewise be molded a part of the unitary plastic piece. Alternately, any spring fingers employed may be separate elements installed in the wall recess(es) of post carrier 122 (or retrofit post carrier 164) and manufactured from metal or plastic or any other suitable material known to those skilled in the art in accordance with the principles described herein. For example, spring fingers may be made of stamped metal then inserted into the wall recesses of the cylindrical recess 150 which would then receive the post ornament. It should be noted that the relative sizes shown in the figures are only exemplary; those skilled in the art may develop specific designs having any reasonable dimensions applying the described principle of the applicable embodiment of the invention.

This concludes the description including the preferred embodiments of the present invention. The foregoing description of the preferred embodiment of the invention has been presented for the purposes of illustration and description. It is not intended to be exhaustive or to limit the invention to the precise form disclosed. Many modifications and variations are possible in light of the above teaching.

It is intended that the scope of the invention be limited not by this detailed description, but rather by the claims appended hereto. The above specification, examples and data provide a complete description of the manufacture and use of the apparatus and method of the invention. Since many embodiments of the invention can be made without departing from the scope of the invention, the invention resides in the claims hereinafter appended.

What is claimed is:

1. A post carrier for a body piercing instrument, comprising:

a cylindrical recess at a first end for holding a post, the post comprising an ornament held within the cylindrical recess, where a cylindrical wall of the cylindrical recess includes at least one wall recess disposed in the cylindrical wall of the cylindrical recess, the at least one wall recess for engaging a point on the ornament of the post; and a cylindrical portion disposed at a second end, opposite the first end of the post carrier, for insertion into a post carrier coupling recess of the body piercing instrument;

wherein each of the at least one wall recess includes a spring finger extending from a side of each of the at least one wall recess, the spring finger for applying a cantilever force substantially perpendicular to the cylindrical wall and into the cylindrical recess.

2. The post carrier of claim 1, wherein the at least one wall recess comprises opposing wall recesses.

3. The post carrier of claim 1, wherein the spring finger in each of the at least one wall recess is flush with the cylindrical wall of the cylindrical recess for holding the post.

4. The post carrier of claim 1, wherein the spring finger in each of the at least one wall recess applies the cantilever force to the point on the ornament engaged in each of the at least one wall recess for holding the post.

5. The post carrier of claim 1, wherein the post carrier is a unitary molded plastic piece.

6. The post carrier of claim 1, wherein the cylindrical portion disposed at the second end comprises a raised lip on an outside diameter of the cylindrical portion.

7. The post carrier of claim 1, further comprising a planar portion disposed between the cylindrical recess and the cylindrical portion.

8. The post carrier of claim 7, wherein the planar portion operates as a stop for indexing against an end of the post carrier coupling recess of the body piercing instrument.

9. A body piercing instrument, comprising:

a handle portion supporting both a post carrier coupling for engaging a post carrier supporting a post comprising an ornament and a nut carrier coupling for engaging a nut carrier supporting a nut, both the post carrier coupling and the nut carrier coupling in substantially parallel sliding engagement such that the post of the engaged post carrier is aligned to pierce a body part and engage the nut of the engaged nut carrier;

wherein the post carrier coupling comprises a cylindrical recess at a first end for holding the ornament of the post where a cylindrical wall of the cylindrical recess includes at least one wall recess disposed in the cylindrical wall of the cylindrical recess, the at least one wall recess for engaging a point on the ornament of the post, and a cylindrical portion disposed at a second end, opposite the first end of the post carrier, for insertion into a post carrier coupling recess of the body piercing instrument wherein each of the at least one wall recess includes a spring finger extending from a side of each of the at least one wall recess, the spring finger for applying a cantilever force substantially perpendicular to the cylindrical wall and into the cylindrical recess.

10. The body piercing instrument of claim 9, wherein the at least one wall recess comprises opposing wall recesses.

11. The body piercing instrument of claim 9, wherein the spring finger in each of the at least one wall recess is flush with the cylindrical wall of the cylindrical recess for holding the post.

12. The body piercing instrument of claim 9, wherein the spring finger in each of the at least one wall recess applies the cantilever force to the point on the ornament engaged in each of the at least one wall recess for holding the post.

13. The body piercing instrument of claim 9, wherein the post carrier is a unitary molded plastic piece.

14. The body piercing instrument of claim 9, wherein the cylindrical portion disposed at the second end comprises a raised lip on an outside diameter of the cylindrical portion.

15. The body piercing instrument of claim 9, further comprising a planar portion disposed between the cylindrical recess and the cylindrical portion.

16. The body piercing instrument of claim 15, wherein the planar portion operates as a stop for indexing against an end of the post carrier coupling recess of the body piercing instrument

17. A post carrier for a body piercing instrument, comprising:

a cylindrical recess means for holding a post at a first end, the post comprising an ornament held within the cylindrical recess means, where a cylindrical wall of the cylindrical recess means includes at least one wall recess means disposed in the cylindrical wall of the cylindrical recess means, the at least one wall recess means for engaging a point on the ornament of the post and a cylindrical portion means for insertion into a post carrier coupling recess of the body piercing instrument and disposed at a second end, opposite the first end of the post carrier;

wherein each of the at least one wall recess means includes a spring finger means extending from a side of each of the at least one wall recess, the spring finger means for applying a cantilever force substantially perpendicular to the cylindrical wall and into the cylindrical recess means.

18. The post carrier of claim 17, wherein the at least one wall recess means opposing wall recess means.

19. The post carrier of claim 17, wherein the spring finger means applies the cantilever force to the point on the ornament engaged in each of the at least one wall recess means for holding the post.

20. The post carrier of claim 17, wherein the cylindrical portion means disposed at the second end comprises a raised lip means for providing a press fit with the post carrier coupling recess of the body piercing instrument.

21. The post carrier of claim 17, further comprising a planar portion means for indexing against an end of the post carrier coupling recess of the body piercing instrument, the planar portion means disposed between the cylindrical recess means and the cylindrical portion means.

* * * * *